US006777050B1

(12) United States Patent
Engelaere

(10) Patent No.: US 6,777,050 B1
(45) Date of Patent: Aug. 17, 2004

(54) RESEALABLE PACKAGING THE CONTAINER OF WHICH INCLUDES A TEARABLE WELDING LAYER, AND ITS MANUFACTURE

(75) Inventor: Jean-Claude Engelaere, Koudekerke-Branche (FR)

(73) Assignee: Soplaril, S.A., Buteaux (FR)

( * ) Notice: Subject to any disclaimer, the term of this patent is extended or adjusted under 35 U.S.C. 154(b) by 0 days.

(21) Appl. No.: 09/574,836

(22) Filed: May 19, 2000

(30) Foreign Application Priority Data

May 21, 1999 (FR) ..... 99 06503

(51) Int. Cl.[7] ..... B65D 41/32; B65D 41/00

(52) U.S. Cl. ..... 428/35.9; 428/34.1; 428/35.7; 220/359.2; 220/359.3; 220/359.4; 53/133.3; 53/133.4

(58) Field of Search ..... 428/34.1, 35.7, 428/35.9, 336–512; 220/359.2–359.4; 53/133.3–133.4

(56) References Cited

U.S. PATENT DOCUMENTS 3,454,210 A * 7/1969 Spiegel et al. ..... 229/43
4,673,601 A 6/1987 Lamping et al.

(List continued on next page.)

FOREIGN PATENT DOCUMENTS

AU 720465 6/1997
DE 29 08 381 A1 9/1980

(List continued on next page.)

OTHER PUBLICATIONS

Ethylene Polymers, Encyclopedia of Polymer Science and Technology, 2002. (reprint from http://www.mrw.interscience.wiley.com).*

(List continued on next page.)

*Primary Examiner*—Harold Pyon
*Assistant Examiner*—Brian P. Egan
(74) *Attorney, Agent, or Firm*—Jones Day

(57) ABSTRACT

The invention relates to a re-closable packaging featuring a container and a cover. The container features a support layer bearing two opposed faces, the innermost face of which is joined to a complexable layer by optionally deposing the face on an outermost face of an optional bonding layer bearing two opposed faces. The optional bonding layer is placed adjacent to a structure featuring: (1) a complexable layer bearing two opposed faces, the innermost face of the optional bonding layer being placed adjacent to the outermost face of the complexable layer, the innermost face of the complexable layer is placed adjacent to an outermost face of (2) a pressure-sensitive adhesive layer bearing two opposed faces, the innermost face of the pressure-sensitive adhesive layer is placed adjacent to a first face of (3) a tearable-welding layer bearing two opposed faces. The cover features a welding layer with two opposed faces, the first face of which is placed adjacent to an innermost face of a support layer bearing two opposed faces. The second face of the tearable-welding layer and the second face of the welding layer are joined by welding along a seam in a welding region to form a welded seam. Optionally, the pressure-sensitive adhesive layer features two pressure-sensitive adhesive sub-layers.

38 Claims, 3 Drawing Sheets

PRIOR TO OPENING

U.S. PATENT DOCUMENTS

| | | | | | |
|---|---|---|---|---|---|
| 4,791,024 | A | * | 12/1988 | Clerici et al. | 428/343 |
| 4,810,541 | A | * | 3/1989 | Newman et al. | 428/36.7 |
| 4,858,780 | A | | 8/1989 | Odaka et al. | |
| 5,037,138 | A | * | 8/1991 | McClintock et al. | 383/34 |
| 5,089,320 | A | | 2/1992 | Straus et al. | |
| 5,167,339 | A | * | 12/1992 | Takata et al. | 220/359 |
| 5,382,472 | A | | 1/1995 | Yanidis et al. | |
| 5,512,124 | A | * | 4/1996 | Hansen | 156/334 |
| 5,882,749 | A | * | 3/1999 | Jones et al. | 428/35.2 |
| 6,106,153 | A | * | 8/2000 | Toshima | 383/204 |
| 6,302,290 | B1 | | 10/2001 | Engelaere | 220/359.4 |
| 6,345,726 | B1 | * | 2/2002 | Beeuwsaert | 220/359.3 |

FOREIGN PATENT DOCUMENTS

| | | |
|---|---|---|
| EP | 0 306 982 B1 | 3/1989 |
| EP | 0 403 393 A1 | 12/1990 |
| EP | 0 661 154 B1 | 7/1995 |
| FR | 2 669 607 A1 | 5/1992 |
| GB | 2 319 746 A | 6/1998 |
| JP | 57-191529 | 11/1982 |
| JP | 3-289467 | 12/1991 |
| WO | WO 90/07427 | 7/1990 |
| WO | WO 97/19867 * | 6/1997 |
| WO | WO 98/23500 | 6/1998 |

OTHER PUBLICATIONS

Styrene Butadiene Copolymer, Material Safety Data Sheet.*
Pentalyn H, Material Safety Data Sheet.*
In re Rijckaert, 9 F.3d 1531 (1993).*
Ethylene Polymers, Encyclopedia of Polymer Science and Technology, 2002 (reprint from http://www.mrw.interscience.wiley.com).*
Styrene Butadience Copolymer, Material Safety Data Sheet.*
Pentalyn H. Material Safety Data Sheet.*

* cited by examiner

RESEALABLE PACKAGING THE CONTAINER OF WHICH INCLUDES A TEARABLE WELDING LAYER, AND ITS MANUFACTURE

BACKGROUND OF THE INVENTION

The present invention relates to a re-sealable packaging, which can be readily opened and then re-sealed or re-closed.

This type of packaging, with a flexible lid or cover able to be re-closed over the container is known, notably in the food industry, both for packagings under gas employing a rigid receptacle (heat-molded or preformed, for example by injection molding) as well as for vacuum packagings with a heat-molded flexible receptacle.

Thus, British Patent application 2,319,746 (in the name of Dolphin) discloses heat-weldable films for re-closable packagings. This packaging comprises a receptacle (A) comprising a support layer (for example in PVC or PET), a layer in PE and a thin film in an isomer resin or in ethylene/methyl acrylate copolymer, and a flexible lid (B) comprising a layer in ionomer or copolymer identical to the preceding layer, with which it co-operates, and a layer of elastomer adhesive, a layer of PE and a support layer (in PVC, PET). In this structure, welding is effected by means of the ionomer resin or ethylene and/or methyl acrylate copolymer, the films (A) and (B) being situated between the sealing jaws, only the upper sealing jaw being heated.

This structure is only functional due to the fact that the ionomer resin or copolymer has a low melting point (and notably less than that of the adhesive layer).

A similar structure is disclosed in international application WO-A-90 07427 (in the name of James River), additionally cited in the above-said Patent application in the name of Dolphin. The structure described in that James River application is adapted to production of flexible bags. The structure comprises a support layer, a layer in an elastomer adhesive, and a "skin", this "skin" being heat-weldable. This "skin" is preferably an ionomer resin or a copolymer of the same type as those disclosed in the above patent application in the name of Dolphin. This structure is welded to itself during manufacture of the bags. At the time of opening, delamination can occur at the adhesive/skin interface or the adhesive/support layer interface or within the adhesive itself. In this latter case of delamination, the sealing jaws between which the structure is welded are both heating jaws.

U.S. Pat. No. 3,454,210 discloses a packaging comprising a container and a lid, this lid comprising e.g. a PET layer, a Corona-treated PE, an adhesive layer and a weldable PE layer. It is furthermore indicated, but without any full disclosure, that the re-sealable film can also be present on the container.

The above packagings have various disadvantages. Firstly, they are not designed to be employed in all types of packaging, whether "under gas" or "under vacuum", whether rigid or flexible, notably flexible bags, and in all types of machine, whether horizontal or vertical. One consequently looks for a "universal" structure able to be adapted to existing machines, and finding general application. Finally, such packagings require, for the heat-weldable layer, the use of ionomer resins which are extremely costly, which makes the final packaging relatively expensive.

SUMMARY OF THE INVENTION

None of the above documents teaches nor suggests the invention.

Thus, the invention provides a re-closable packaging comprising:

(A) a container, said container comprising a support layer (1), a pressure-sensitive adhesive layer (3) and a tearable welding layer (4); and, facing said container, (B) a cover member or lid, said cover member comprising a welding layer (5) and a support layer (6), said tearable welding layer (4) and said welding layer (5) being welded along a seam (D).

According to one embodiment of the re-closable packaging, the pressure-sensitive adhesive layer (3) is applied directly to said support layer.

According to another embodiment of the re-closable packaging, a complexable layer (2) is arranged between said support layer (1) and said pressure-sensitive adhesive layer (3).

According to one embodiment of the re-closable packaging, a structure (C) comprising layers (2), (3) and (4) is laminated onto said support layer (1).

According to a further embodiment of the packaging, said container (A) is a rigid tub or receptacle.

According to a further embodiment of the packaging, said container (A) is a flexible receptacle.

According to a further embodiment of the packaging, said container (A) is thermoformed.

The invention further provides a re-closable packaging of a second type comprising:

(A) a container, said container comprising a support layer (1), a complexable layer (2), a pressure-sensitive adhesive layer (3) and a tearable welding layer (4); and, facing the tearable welding layer of (A) is the container (A'), that container comprising a support layer (1'), a complexable layer (2'), a pressure-sensitive adhesive layer (3') and a tearable welding layer (4') where the tearable welding layer (4') of (A') faces the tearable welding layer (4) of (A);

said tearable welding layers being welded along a seam (D).

According to one embodiment of the second type of re-closable packaging, said containers form the same structure closed about itself.

According to one embodiment of the second type of re-closable packaging, said containers are flexible films.

In a further embodiment of the re-closable packaging, tearing at said seam takes place within said adhesive layer (3).

In a further embodiment of the re-closable packaging, the melting point of the said tearable welding layer is higher than that of said adhesive layer. The term "melting point" as regards the adhesive is intended to mean its softening point.

According to a further embodiment of the packaging, said pressure-sensitive adhesive layer comprises a thermoplastic elastomer-based hot melt adhesive.

According to yet a further embodiment of the packaging, said adhesive comprises from 5 to 25% by weight filler-containing master batch.

According to a further embodiment of the packaging, said welding layers comprise polyethylene.

According to one embodiment of the re-closable packaging, said tearable welding layers comprise metallocene PE.

The complexable layers and tearable welding layers preferably have identical compositions.

In a further embodiment of the re-closable packaging, said structure comprising said layers (2), (3) and (4) is symmetrical in composition, said pressure-sensitive adhesive layer (3, 3') comprising two pressure-sensitive adhesive sub-layers.

According to one embodiment of the re-closable packaging, said structure is obtained by collapsing the co-extrusion bubble.

According to one embodiment of the re-closable packaging, collapsing the co-extrusion bubble is done under oxidizing conditions.

The invention also provides a method for producing a packaging according to the invention, comprising sealing said welding layers (4) and (5).

In one embodiment of the method, said structure, comprising said support layer (1), said complexable layer (2) and said pressure-sensitive adhesive layer (3) is prepared first after which said container is prepared.

In one embodiment of the method, said structure is laminated onto said container.

In another embodiment of the method, said structure is prepared by collapsing the co-extrusion bubble.

In one embodiment of the method, for producing a packaging, said support layer (1), pressure-sensitive adhesive layer (3) and tearable welding layer (4) are prepared by co-extrusion or by calendering.

Sealing is preferably done, for preparing a packaging of the first type, by die pressing between two sealing jaws only one of which is heated at said lid or cover member (B) side.

For preparing a packaging of the second type, sealing is preferably done by die pressing between two sealing jaws only one of which is heated.

The invention will now be described in more detail below, with reference to the attached drawings.

DETAILED DESCRIPTION OF THE PREFERRED EMBODIMENTS

Figure 1:
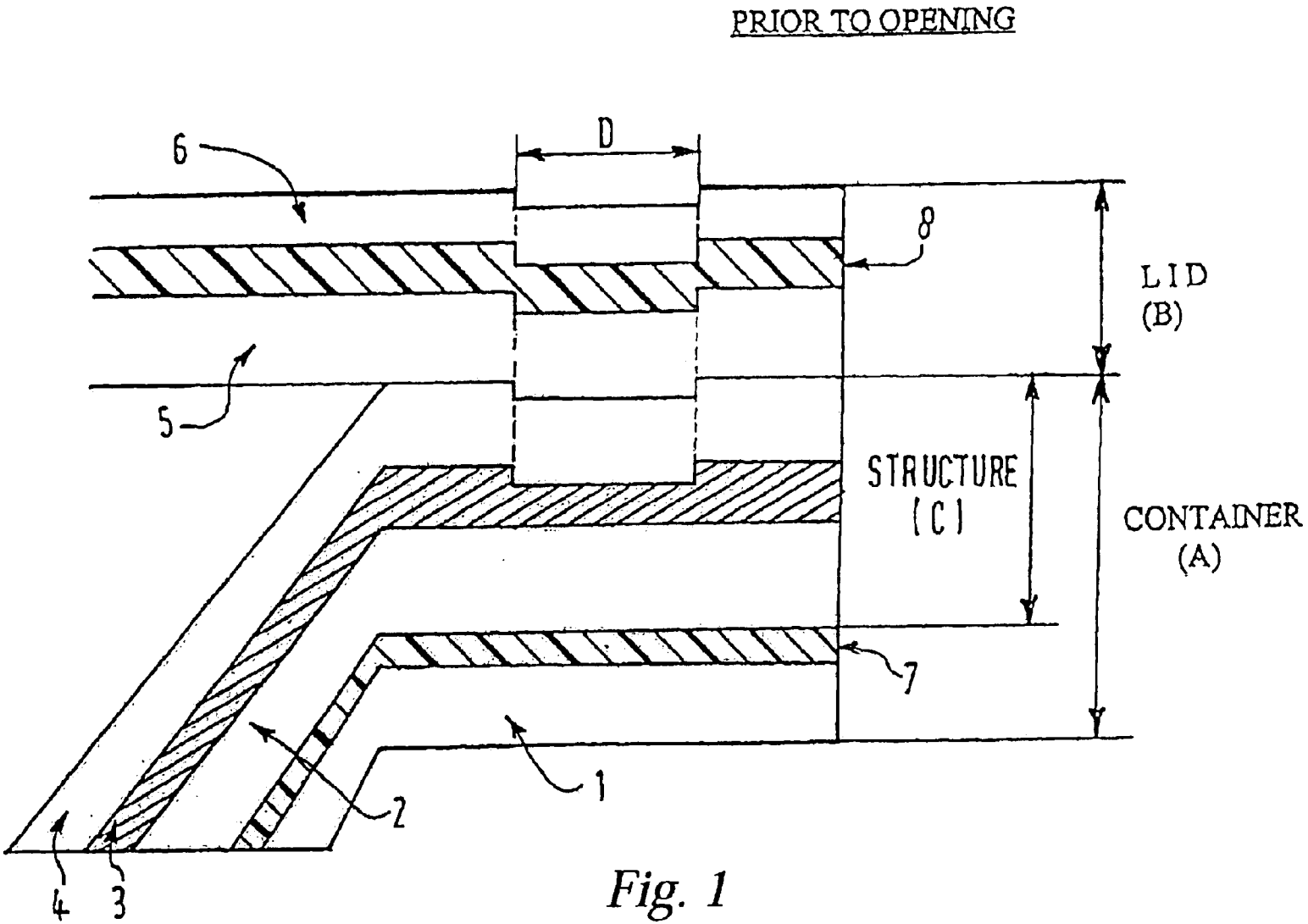
FIG. 1 shows the packaging in one embodiment of the invention prior to opening.

FIG. 1 illustrates the packaging in one embodiment of the invention, after welding. This packaging comprises a container (A) and a lid (B). Container (A) comprises a support layer (1), an optional complexable layer (2), a pressure-sensitive adhesive layer (3) and a tearable welding layer (4). The container can also comprise, between the support layer (1) and the complexable layer (2) a bonding layer (7), if necessary. One sub-portion of this container (A) is the structure (C), which comprises the layers (2), (3) and (4). Lid (B) comprises a support layer (6) and a welding layer (5) bonded together by optional bonding layer (8). The tearable welding layer (4) and welding layer (5) face each other. Lid (B) is welded to container (A) for example by die pressing, using sealing jaws of which preferably only one is a heating jaw, the latter being disposed at the lid side. In other words, deformation of container and lid occurs in the welding region, seam (D). This deformation is characterised by a reduction and/or modification in thickness, due to softening and/or melting of certain layers which leads to creep of their components over the edges of the welding seam. The welding region (seam (D)) delimits the weakened region. Support layer (6) of the lid (B) is in general little affected by welding, as the components of the support layer have a melting point which is generally distinctly higher than that of the components of the welding layer (5). The same generally applies to bonding layer (8) of the lid. The above remarks similarly apply to support layer (I) and bonding layer (7) of container (A), which, additionally, are further from the source of heat in the preferred case where only one heated sealing jaw is used at the lid side.

Welding conditions (time, temperature, pressure) are set conventionally so that deformation is located at the tearable welding layer (4) and welding layer (5). As adhesive layer (3) is generally malleable by its nature, and generally represents a relatively insignificant thickness of structure (C), there would generally not be melting or creep (lateral flow) throughout the totality of the thickness. As the adhesive layer substantially supports all of the deformation, complexable layer (2) will consequently, generally, not be deformed and consequently not weakened. The weakening, at the welding seam, is consequently principally generated in the tearable welding layer (4), and possibly, partially in adhesive layer (3). Welding layer (5) is not fragile and its tear strength is greater than that of layer (4), as well as the cohesive strength of adhesive layer (3). When the packaging is opened, stresses propagate and bring about rupture at the most fragile layers, in other words the tearable welding layer (4) and a part of the thickness of the adhesive layer.

Figure 2:
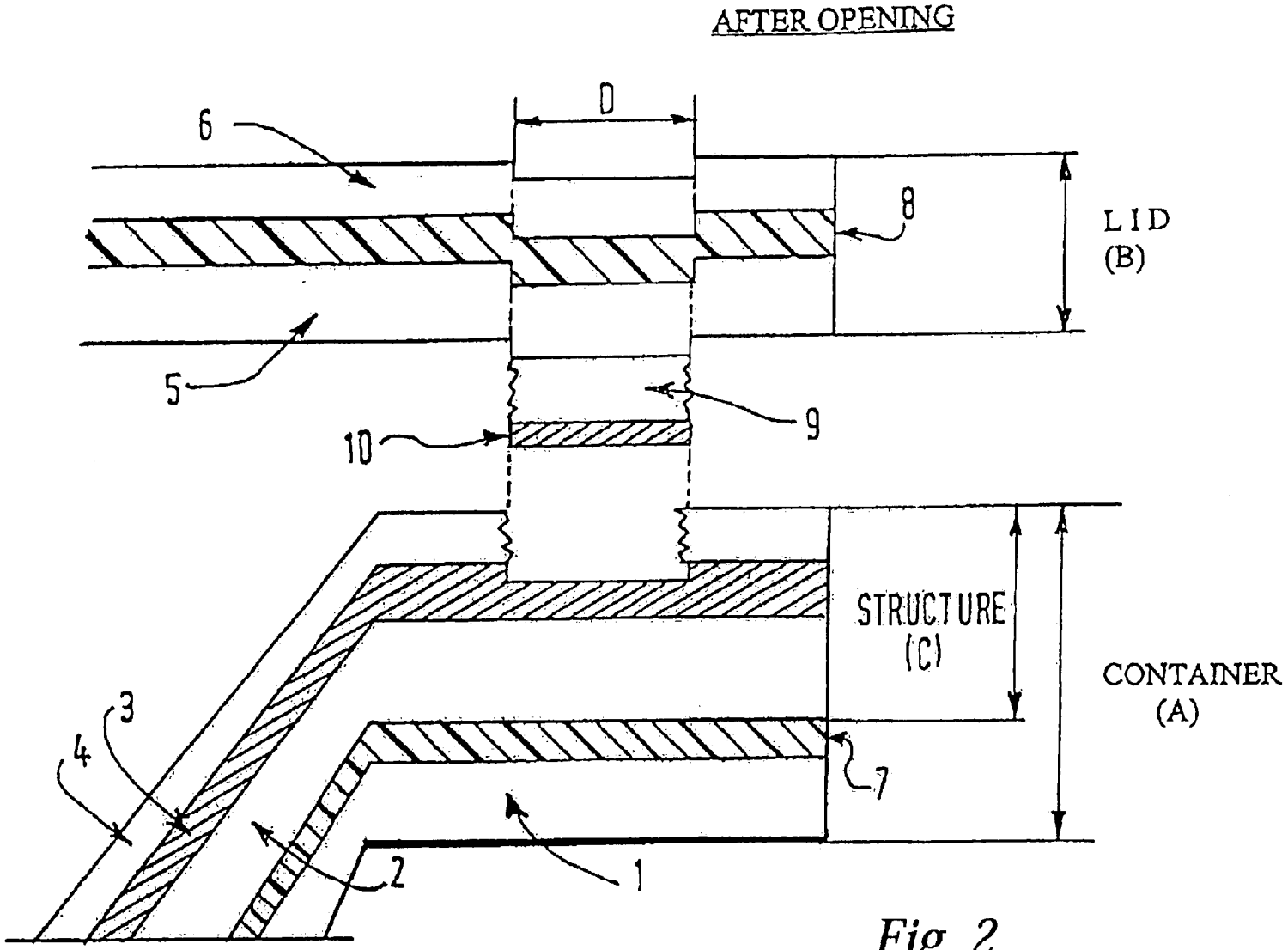
FIG. 2 shows the packaging in one embodiment of the invention after opening.

FIG. 2 shows the packaging according to the invention after opening. Tearing occurs at both sides of the welding seam (D) (the regions where the jaws operate), the effect of which is to uncover a strip composed of the torn tearable welding layer (9) and a part (10) of pressure sensitive adhesive layer (3), which remains welded to the welding layer of lid (B). After opening, a part of pressure sensitive adhesive layer (3) providing for re-sealing, is located on each one of the inner faces of container (A) and lid (B) of the packaging. It is now sufficient to reposition the two regions corresponding to the tear face-to-face and to exercise pressure in order to re-close the packaging. The re-sealing force (re-bonding of the adhesive to itself) is proportional to the pressure exercised for re-closing. In general, tearing in the adhesive layer leads to the latter appearing slightly cloudy due to surface irregularity of the rupture giving an iridescent effect. Re-sealing is now at a maximum when the pressure exerted renders the tear region again transparent. In effect, in this case, the continuity of the adhesive layer has been reconstituted, and this adhesive layer no longer shows any surface iridescence. Reopening and re-closing are identical to the operations described above.

One advantage of the invention compared to the prior art in the case of a (heat-) molded structure with a lid resides in the fact that the adhesive is located at container level. Thus, by using only one single heated sealing jaw for welding, and by doing the welding at the lid side (which is, in general, the case as the lid is usually thinner than the receptacle), the invention makes it possible to limit deformation of the adhesive, as the latter is further from the source of heat than in the prior art.

One could also have tearing occur at the adhesive layer (3)/welding layer (4) interface, and even, possibly, at the adhesive layer (3)/complexable layer (2) interface. It is however preferred that the rupture be a cohesive rupture (rupture in the thickness of the layer by loss of cohesion) in adhesive layer (3). Such a cohesive rupture can notably be obtained in two ways: firstly, by adding additives and, secondly, by the bubble collapsing technique. These two methods, which are not limiting, are described below.

It will be noted at this point that the type of packaging of the above embodiment could be described, speaking simply, as a conventional packaging in which the welding film is replaced by a multilayer structure (C). We now have a packaging in which the adhesive is no longer in the lid but rather in the container, which is the reverse of resealable packaging prior art, in which the adhesive layer is found in the lid.

In the case where flexible pouches or bags are produced, the multilayer film forming container (A) is welded to itself. In this case, the packaging can now be thought of as comprising two joined containers, one (A) on one side of the weld and the other (A') on the opposite side of the weld, each having the same configuration. The mechanism of operation is the same as above. Also in this case, a system of sealing jaws which only apply heat on the one side will preferably be used. The portion located at the heated sealing jaw side undergoes die pressing whereas the one at the unheated side does not undergo this. In this way, upon opening, only the tearable welding layer that was situated at the heated side tears, and opening is consequently better defined. Thus, the situation is now identical to the one described previously. Container (A') could also comprise a bonding layer (7'), just like container (A). Generally, where flexible bags are produced, elements (A) and (A') are formed from the same structure.

It is clear that the complexable layer (2) is not essential and can be omitted, for example where the sheet from which container (A) is produced has been made by extrusion. In this case, adhesive (3) will be provided directly on the support (1). In the case of co-extrusion, one can for example produce a tearable multilayer of the PET or PS type, or a PP/hot melt type adhesive/PE multilayer on a suitable line (such as a (flat) cast coextrusion line able to produce heat-shapeable semi-rigid sheets of the order of 500 $\mu$m). In the case of calendering, the complexable layer is generally present and one can first co-extrude a triple layer film comprising complexable PE/hot melt adhesive/tearable PE, and apply it, a bit further on, to a support film, for example a PVC film (in such a case the complexable layer is not corona treated). The support film leaving the calendar is still hot (just like, generally, the extruded triple layer film) when the triple layer film is applied. This ensures maximum avoidance of deformation of the support sheets, such as PVC sheets. Adhesion of the double layer film is improved when application thereof is done using a calendar. The final multilayer product can then be subject to hot forming or another treatment, if necessary. As against this, this complexable double layer will be generally present when the sheet from which container (A) is made is produced by a lamination process.

The various layers will now be described in more detail.

Container (A) comprises, schematically, a support layer (1), on which structure (C) is applied, said structure (C) comprising layers (2), (3) and (4).

This structure (C) has a thickness generally comprised between 20 and 200 $\mu$m, preferably 30 to 100 $\mu$m. Adhesive layer (3) preferably makes up more than 30%, advantageously more than 40% of the thickness of structure (C); layers (2) and (4) each generally make up from 10 to 50%, preferably from 10 to 30% thereof.

Complexable layer (2) (or layer for lamination) is located on the inner face and is designed to be bonded to the support layer (1), optionally through a bonding layer (7). This complexable layer will advantageously be Corona discharge treated (especially in case of lamination), preferably such that its surface tension is greater than 38 dynes. This layer is conventionally a polyolefin. Corona treatment facilitates keying of complexable layer (2) to support layer (1), preferably via a bonding layer (7); notably, this layer is an adhesive. Complexable layer (2) thus makes it possible:

(i) to balance the structure during co-extrusion to prevent the film "rolling" about itself, this being detrimental to machinability during complexing;

(ii) to protect the adhesive layer which is thus sandwiched;

(iii) to impart body to (in other words rigidity to) the structure, (polyolefins being fairly rigid), which improves its withstand abilities and machinability; and (iv) to facilitate extrusion of the adhesive layer as layer (2) plays the role of a support and prevents sticking to the various elements of the co-extrusion line.

This complexable layer can be transparent or opaque. Its thickness can vary from 10 to 100 $\mu$m, preferably from 10 to 30 $\mu$m.

This complexable layer is a polyolefin. This term, i.e., polyolefin, should be taken in its normally acceptable sense in the art. By way of examples we can cite homopolymers and copolymers of olefins, with other olefins or other types of monomer (such as vinyl acetate, alkyl (meth)acrylate). Specific examples are: PE (such as: HDPE, MDPE, LMDPE, LDPE, LLDPE, VLDPE, metallocene PE), PP, copolymers of PE with an alpha-olefin, EVA copolymers, etc.

The composition of this layer can also be adapted to improve adhesion to adhesive layer (3). Thus, this layer can comprise from 20 to 90%, preferably from 50 to 70%, metallocene PE or co-extrusion binder (such as those based on modified PE).

Various additives can be present, for example anti-oxidizing agents, anti-blocking agents, slip agents, etc., notably for facilitating extrusion and machinability (processability) of the film.

Tearable welding layer (4) is located on the outer face of structure (C). Its function is to provide closing of the packaging by heat sealing. The layer is either sealed to itself (when making bags or pouches) or onto the welding layer of the lid (for example, weld between the lid and a rigid receptacle or tub). This layer (4) is tearable, preferably in both directions (machine direction MD and transverse direction TD). Such a tearability is for example obtained through the choice of the resins employed in the mixture and/or by adding mineral fillers which increase fragility and/or by adjusting thickness. The melting temperature of this layer (4) is generally greater than that of welding layer (5).

This tearable welding layer can be transparent or opaque. Its thickness can vary from 10 to 100 $\mu$m, preferably from 10 to 30 $\mu$m.

This layer is generally a polyolefin; the polyolefin can notably be the same as the one employed for the complexable layer.

This tearable welding layer, being on the outside, will advantageously have good machinability, obtained, for example, by adding slip and anti-blocking agents facilitating sliding over the elements of the packaging machine. Such sliding will in particular be appreciated when using vertical machines. ($Ks<0.25$, where Ks is the static coefficient of sliding). This welding layer will advantageously have hot adhesive properties (or hot resistance properties) even while the weld or seal is still hot: the seal will not re-separate when the product to be packaged falls into the bag (in the case of a vertical machine) and/or when a gas is injected from the thermoforming machine (in other words said welding layer advantageously has "hot tack" properties). For this latter property, metallocene PE will advantageously be added to the said welding layer. The formulation of this tearable welding layer will also preferably be adjusted to prevent a tacky feel, in order to avoid all undesirable sticking or any contamination by the packaged product. The fillers that can be added in order to encourage tearing are inorganic fillers, such as talc and calcium carbonate, present in amounts comprised for example between 5 and 30%, preferably between 5 and 15%.

Other additives can also be added, such as anti-misting agents, and surfactants can also be deposited on its outer face.

This tearable welding layer tears substantially only in the weld region, in other words seam (D). The layer is in effect more fragile in this region. The die pressing of the welding region reduces its mechanical strength which becomes below that of the non-welded regions. Tearing strength can vary; it will however be adjusted to be advantageously situated between 700 and 1000 g/15 mm, which corresponds to the values for current peelable films.

A wide weld region or seam is advantageous, in order to facilitate re-closing of the packaging and to guarantee a sufficient re-adhesion force. Seam width will for example be from 4 to 12 mm, preferably between 5 and 8 mm.

Adhesive layer (3) ensures re-closing of the packaging once opened.

This layer is sandwiched between complexable layer (2) and the tearable welding layer (4). Adhesion of the adhesive layer onto these layers is preferably greater than the value corresponding to the tearing force to be applied to the welding seam while the packaging is being opened. Such adhesion will consequently preferably be greater than 1000 g/15 mm. To obtain this adhesion, the complexable and tearable welding layers comprise, for example, a metallocene PE or a bonding resin. Tearing will preferentially occur in the adhesive layer; rupture is cohesive. Thus, a portion of the pressure sensitive adhesive will be located on each face of the packaging. Re-closing force thus becomes a maximum as there is adhesion of the adhesive to itself. Additionally, if the tearable welding layer for example comprises metallocene PE or a binder, there will also be good adhesion of the adhesive on this layer, which facilitates packaging face repositioning.

The adhesive layer comprises a pressure-sensitive adhesive (or is self-adhesive) . This can be a hot melt adhesive, notably based on an elastomer or other polymers which are not elastomeric, such as EVA. This adhesive may also not be of the hot melt type, but be diluted in a solvent medium or aqueous phase.

Very generally speaking, and without this being limiting, the hot melt adhesives comprise:

a) polymers such as EVA, PE, PP, EEA (ethylene ethyl acrylate) and the thermoplastic elastomers or rubbers is ((block) styrene copolymers of the styrene-butadiene type, styrene-isoprene, styrene-ethylene/butadiene type, or butadiene-based polymers such as NBR or, yet again, ethylene-propylene copolymers such as EPR). They make up from 5 to 50% of the formulation and their purpose is to provide: adherence (polarity), barrier properties, brilliance, mechanical strength, flexibility and viscosity control.

b) resins (tackifyers) which can be natural (colophane esters, terpene or terpene-phenolic esters), or oil-based, aliphatic or aromatic. They make up from 0 to 45% of the formulation. They increase the hot tack, adherence and control cohesion.

c) paraffins and waxes, which can make up some 20 to 80% of the formulation. They play a role in providing barrier, brilliance, rigidity, cost, drop point, and hot melt hardness properties.

d) plasticizers which can make up some 0 to 10% of the formulation. They increase cold tack and control hot melt flexibility and viscosity.

e) anti-oxidants which make up from 0.2 to 10% of the formulation. They stabilise the components when hot and when cold.

f) fillers which make up part of the formulation when particular properties are desired such as UV-resistance (oxidation resistance), flame proofing, anti-allergy properties, rheology, tearing in the thickness, etc.

Preferably a self-bonding hot melt adhesive is employed constituted by a mixture of elastomer and tackifying resin. The adhesive consists of a mixture of:

40 to 80% thermoplastic elastomer 20 to 60% tackifying resin

<30% of other constituents: plasticizing oil, anti-oxidation agents, additives etc.

One example of such a hot melt adhesive is M3062 from Ato Findley (melt index of 5.3 g/10 min, at 190° C. under 2.16 kg).

The adhesive will notably comprise, by way of additives, inorganic fillers of the talc or calcium carbonate type, or processing agents (fluorine-containing products), introduced in relatively large amounts (compared to the amounts normally employed). For example, in the case of inorganic fillers, content is for example between 3 and 15% by weight. For example, in the case of fluorine-containing products, content is for example between 0.2 and 3% by weight.

The additive is added in the majority of cases in the form of a master batch; in this case, the adhesive in general comprises from 5–25% by weight of a master batch containing a filler or processing agents.

By way of examples of additive-containing adhesive able to be used in the invention the following formulations can be mentioned:

a) 93% M 3062 and 7% of Schulman RTL 109B master batch (composed of 70% talc flake and 30% PE resin).

B) 80% M 3062 and 20% of Schulman Polybatch AMF 702 master batch (composed of 2% Viton Free Flow 10 from Du Pont and 98% PE resin).

These additives are however not employed where the process is the "bubble collapsing" process.

It is also desirable that a multilayer film comprising a layer and an adhesive as above, may be transformed. One will consequently preferably choose adhesives of sufficiently high viscosity to avoid, or limit to the maximum extent, creep (which would otherwise lead to deformations such as variations in thickness, formation of "waves", etc) as well as flow of adhesive between the layers during thermoforming and its flowing onto the welding equipment.

High viscosity also reinforces the phenomenon of absence of deformation when a heated sealing jaw is applied to make the weld (with welding taking place at the lid side).

Binder layers can be present, between the adhesive and complexable layers and/or between the adhesive and tearable welding layers and/or between the adhesive layers and the support. If such layers of binder (L) are employed (the structure then becoming a five-layer structure such as PE/L/HotMelt/L/PE), the complexable layers and/or tearable welding layer (and/or support layer) can then have a simpler composition, without adding binder and/or metallocene PE (even in this case however, a welding layer supplemented by additives is preferred). The binder able to be employed in the pure state in the intermediate layers, or diluted in the complexable and/or tearable welding layers is a coextrusion binder which can be notably chosen from the above polyolefins which are modified. As starting polyolefin, one will for example take PE, EVA copolymers with a high monomer content, etc. Modification is done by grafting or copolymerization. For example, the polyolefin can include maleic groups (for example, via maleic anhydride). It is possible to use as a binder pure metallocene PE.

The binder is preferably chosen so that the adhesion force is greater than the tearing force of the adhesive layer.

When binder layers are employed, the thickness of the structure (C) is then for example comprised between 40 and 200 $\mu$m, preferably 50 to 100 $\mu$m. The thickness of the binder layers is generally comprised between 2 and 10 $\mu$m, preferably between 3 and 5 $\mu$m.

Figure 3:
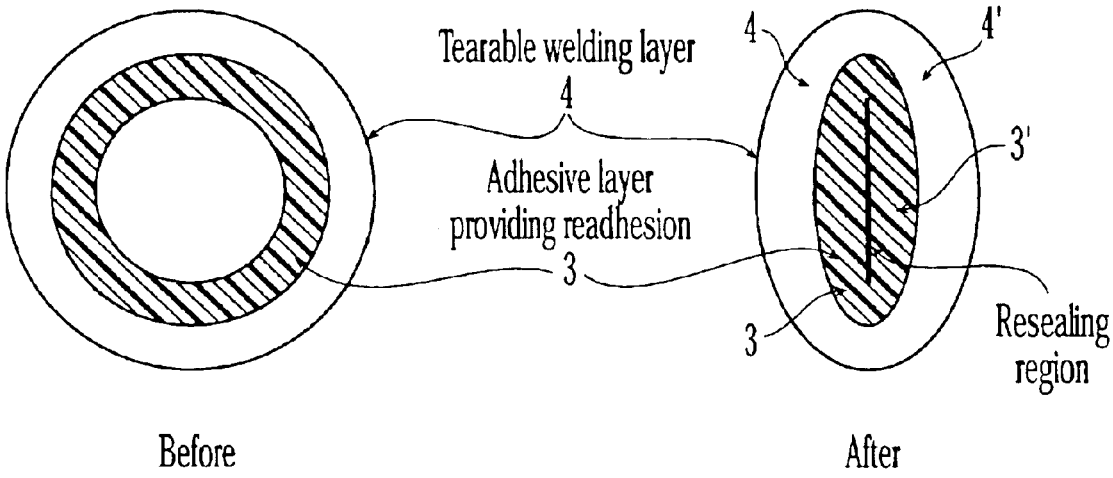
FIG. 3 shows the extrusion bubble in one embodiment, before and after collapsing.

Several processes can be used to prepare structure (C). These processes comprise cast extrusion (flat exclusion), blown film extrusion (blown bubble extrusion), etc. One valuable process is the blown film extrusion process in which, preferably, structure (C) is obtained by collapsing the co-extrusion "bubble". This embodiment is shown in FIG. 3. This embodiment produces a symmetrical structure, wherein the complexable layer (2) and tearable welding layer (4) have the same composition. If adhesive layer (3) comprises two sub-layers **(3*a*) and (3*b*) respectively, then, in such embodiment, layer (3') would also comprise two corresponding sub-layers: (3*a*)' and (3*b*)'. In any event, there is now a region of weakness between the two layers where 3 abuts 3'**; in effect, in the re-adhesion region, the adhesive resin adheres to itself whereas in the case of one layer, the latter has been obtained by melting, leading to the formation of a homogeneous mass which is stronger thanks to its elastomeric nature. Using collapsing of the bubble, the need to modify the composition of the pressure-sensitive adhesive to be absolutely sure of achieving ready tearing within the body of the adhesive layer becomes superfluous.

When extruding the tube, air is generally employed for blowing (expanding) the bubble and for cooling it. The air produces a slight surface oxidation of the (hot melt) adhesive layer prior to re-bonding. The force needed to achieve tearing in the adhesive layer is smaller in the region where the layers have been rebonded, due to the slight surface oxidation thereof, compared to that within the actual layers Such oxidation can further be favored by injecting an oxidizing agent at the bubble. Ozone taken from the Corona discharge treatment equipment can be employed as the oxidizing agent.

Collapsing of the bubble can for example take place at a temperature comprised between 40 and 60° C. and at a pressure from 4 to 6 bars, preferably around 5 bars, at haul-off roller level.

Another possibility is to vary operating conditions. In effect, the re-bonding strength of the layers is a function of the pressure exercised by the haul-off rollers and of film temperature. It is possible to adjust these parameters so that the strength of the new bond is lower than the forces of adhesion between the adhesive layer and the complexable/tearable welding layers. In this way, the adhesive layer will of necessity be present on both faces of the packaging (after opening).

This bubble collapsing technique can also be applied to structures comprising binder layers. The apparatus will be suitably adapted; layer composition will also be adapted as indicated above.

It should be noted that this structure obtained by bubble collapsing can apply to any type of packaging, whether according to the invention or according to the prior art. Thus, the structure can be employed as an integral part of a container or of the lid, or as a film able to be sealed to itself when making bags or pouches. Thus, this structure obtained by bubble collapsing can notably apply to the packagings that are the subject-matter of international application WO-A-97 19867 in the name of the applicant, as well as to the packagings disclosed in French Patent application 2,669,607, U.S. Pat. No. 4,673,601 and European Patent application 0661154.

Thus, the invention will find application notably (but not limited to) in a closing structure provided with an opening comprising a sheet sealed along the edge of the opening, this sheet being constituted of at least three layers, viz a welding layer applied and welded along a seam against the edge of the opening, an outer layer forming a barrier, and an intermediate adhesive layer; welding of the welding layer seam on the edge of the opening will have a resistance to being torn-off greater than the adhesive force between the welding layer and the adhesive layer so that, at the first operation for opening up the opening, the welded seam will remain in place on the edge of the opening and will separate from the remainder of the welding layer and from the adhesive layer which is consequently exposed in one region and allowing, following fresh application against the seam, the container to be once again closed. In this case, the structure according to the invention provides the welding layer and the adhesive layer, the complexable layer becoming integral with the outer barrier-forming layer (which then comprises the complexable layer and a support layer).

The multilayer structure (C) obtained by collapsing the bubble according to the invention can also be applied to doypacks (bags or sachets which stand upright, for example washing powder refills) to facilitate their opening and ensure ready re-closing. This avoids having to add a zip ® strip which is expensive and difficult to apply during manufacture (risk of leakage). This structure can also serve for closing pots and trays obtained by injection molding. The structure can also be employed as a sealing agent in structures intended for packaging on a horizontal machine of the FFH type (for example for long-conservation bread, cheese slices).

The structure (C) according to the invention, whether or not it is obtained by collapsing the bubble, can be applied to a support film. The support film provides the mechanical and gas-barrier properties, as well as a water vapor barrier and one against smells.

For the support film, one can employ polyolefins (cast PP, oriented PP, PE), polyamides (cast PA, copolyamide, mono- or bi-oriented PA), styrenic plastics (crystalline PS, impact PS, oriented PS), PVC, impregnated or non-impregnated papers, polyesters (cast PET, oriented PET, crystallizable PET, PET G), aluminum, impregnated films (impregnated with PVDC, PVA, and the like), vacuum packaging metallized films (aluminum-based, in alumina, $SiO_X$, and the like).

Structure (C) is preferably laid on the support. According to this embodiment, the structure (C) is first prepared, notably by co-extruding, then this structure is applied onto the support by various techniques. It is possible to lay on this structure (C) by lamination, extrusion-lamination, hot-calendering or extrusion-coating. Depending on the technique used, the complexable layer receives an optional bonding layer.

In the first two techniques above, a bonding layer (7) is present between the structure of the invention and the support and provides adhesion.

In case of lamination, structure (C) is prepared, notably by coextrusion, then laid on the support, notably under cold conditions (i.e. a temperature below the melt temperature of the various films). The bonding layer can be an adhesive or glue, notably a polyurethane adhesive or glue, especially of the polyether or polyester type, in a solvent or not. A corona treatment of the complexable layer is preferred.

In case of extrusion-lamination, structure (C) is prepared, notably by coextrusion, then laid on the support, (notably under cold conditions), a bonding layer being placed between the structure (C) and the support, preferably by extrusion. This bonding layer can be a coextrusion binder of the type disclosed above. This binder will have preferably a melt temperature below the one of the support layer. Extrusion-lamination is similar to lamination, except that a binder is used in lieu of a glue. A corona treatment of the complexable layer is possible but optional.

In case of hot-calendering, structure (C) is prepared, notably by coextrusion, then directly applied onto the support (1), through calendars, which heat the previously prepared films. The layers being hot, they will adhere to each other. In this case, although it is possible, it is not necessary to use a supplementary bonding layer (7), the complexable layer (2) being sufficient to ensure binding. This complexable layer can be e.g. a high content EVA layer. A corona treatment of the complexable layer is not necessary, it is not even desirable.

In case of extrusion-coating, the structure (C) coextruded still hot (optionally with a supplementary bonding layer) is applied, while still hot, directly onto the support (e.g. a PET film).

It is preferred that the assembly formed of all layers of the structure, the bonding layer and the support are not coextruded together, in opposition to the prior art.

Once the structure (c) has been laid on the support, this assembly is preferably thermoformed.

The lid comprises the support film (6) of the type described above, and the welding layer (5) of the type also described above. The tearable welding layer (4) and welding layer (5) will have the same composition, or differing compositions (while still however being compatible). These layers (6) and (5) can be bonded together, if necessary, by means of a bonding layer (8). This binder can be of the same type as that described above.

The layers can comprise sub-layers, if appropriate. Thus, the support layer can comprise two layers of PET, between which a layer of printing ink and a layer of binder are located. Similarly, the complexable layer can comprise e.g. a high content EVA layer and a PE layer (adhesive side); this supplemental layer may act as a reinforcing layer.

The following examples illustrate the invention without limiting it.

EXAMPLE 1

Ham Slices Packaged Under Gas

The ham slices are packaged in a packaging composed, in its lower portion, of a container comprising a rigid thermoformed film and, in its upper portion, of the lid or cover comprising a flexible printed closing film. The container, of a total thickness of around 400 μm, is composed of the structure (C) of 50 μm thickness, laminated, using a polyurethane adhesive with a solvent, of 3 μm thickness, onto a rigid PVC film of 350 μm thickness. Layer thickness of the layers of structure (C) is distributed as follows:

- 14 μm of a greater than 38 dyne surface tension Corona discharge treated complexable film;
- 26 μm of pressure-sensitive adhesive layer;
- 10 μm of tearable welding layer.

The complexable layer has the following composition:

- metallocene PE resin (60%)
- LDPE resin (35%)
- Master batch additives: slip agent, anti-blocking agent and anti-oxidant (5%)

The adhesive layer has the following composition:

- 80% M3062, and
- 20% of Schulman Polybatch AMF 702 master batch (composed of 2% Viton Free Flow 10 from Du Pont and 98% PE resin).

The tearable welding layer has the following composition:

- metallocene PE resin (65%)
- MDPE resin (20%)
- Master batch containing filler (10%)
- Master batch containing additives: slip agent, anti oxidant and processing aid (5%)

Complexing is done on a solvent complexing apparatus, adhesive being deposited on the complexable face of the structure (C). Thermoforming of the film is done to a depth of 16 mm to allow the ham slices to be put into place. Thermoforming temperature is comprised between 100 and 130° C.

The lid or covering film is printed and has a total thickness of 96 μm. Its structure is composed of:

- 50 μm of PVDC impregnated bi-oriented PET;
- 2 μm of printing ink layer;
- 3 μm of polyurethane adhesive;
- 23 μm Am bi-oriented PET (for giving the film body);
- 3 μm polyurethane foam;
- 50 μm welding layer.

This welding layer has the following composition:

- LDPE resin (49%)
- Linear octene PE resin (48%)
- Additives: slip agent, anti-blocking agent and anti-oxidant (3%)

The two 3 μm layers of polyurethane+solvent adhesive provide the bond between the layers and are applied using a complexing machine with solvent extraction.

Welding of the two films composing the packaging is done at a temperature of 150° C. under 6 bars pressure for 1.5 seconds, using sealing jaws having either a flat or curved surface.

The force needed to open the packaging is between 800 and 1000 g/15 mm while the force obtained after the first re-closing is between 500 and 800 g/15 mm (as a function of the pressure applied). Opening force remains greater than 400 g/15 mm after 10 opening and re-closing operations.

EXAMPLE 2

Dried Fruit Packaging

Dried fruit are packaged loose in a packaging composed, in its lower portion, of a container film comprising a rigid thermoformed film and, in its upper portion, a lid comprising a flexible printed closing film. The container, of a total thickness of around 510 μm, is composed of a structure (C) of 60 μm thickness, laminated, by means of a solvent-less polyurethane adhesive 1 μm thick, onto a rigid amorphous PET film 450 μm thick. Thickness distribution of the layers of structure (C), obtained by bubble collapsing, is as follows:

- 15 μm of more than 38 dyne Corona discharge treated complexable layer;

15 μm of a pressure-sensitive adhesive layer;

15 μm of a pressure-sensitive adhesive layer;

15 μm of tearable welding layer.

The structure is obtained by bubble collapsing, with an oxidizing medium.

Because of collapsing of the bubble, both the complexable and tearable welding layers have the same composition as follows:

metallocene PE resin (65%)

MDPE resin (20%)

Master batch containing filler (10%)

Master batch containing additives: slip agent, anti-oxidant and processing aid (5%)

Due to collapsing of the bubble, the adhesive layers have the same composition as follows:

M3062

Complexing is done on a complexing machine without solvent, the adhesive being deposited on the complexable face of structure (C). Heat shaping of the film is done to a depth of 25 mm to allow the dried fruit to be put into place. The thermoforming temperature is comprised between 100 and 130° C.

The lid or covering film is printed and has a total thickness of 99 μm. Its structure is as follows:

12 μm of bi-oriented PET;

2 μm of printing ink layer;

1 μm of solvent-free polyurethane adhesive;

23 μm of bi-oriented PET (for giving the film body);

1 μm of solvent-free polyurethane adhesive;

60 μm welding layer.

The composition of the welding layer is as follows:

LDPE resin (49%)

Linear octene PE resin (48%)

Additives: slip agent, anti-blocking agent and anti-oxidant (3%)

The two 1 μm layers of solvent-free polyurethane adhesive provide the bond between the layers and are deposited using a complexing machine without solvent.

Welding of the two films composing the packaging is done at a temperature of 155° C., under a pressure of 6 bars for 1.5 seconds, using sealing jaws which can be flat or curved.

The force needed to open the packaging is between 900 and 1,200 g/15 mm (as a function of the pressure exercised). The force required to open the packaging remains greater than 400 g/15 mm after 10 opening and re-closing operations.

What is claimed is:

1. A re-closable packaging comprising a container and a cover;

wherein the container comprises a support layer bearing two opposed faces, the innermost face of which is joined to a complexable layer by placing said face adjacent to an outermost face of a bonding layer bearing two opposed faces, the bonding layer is placed adjacent to a complexable layer bearing two opposed faces, the innermost face of the bonding layer being placed adjacent to the outermost face of the complexable layer, the innermost face of the complexable layer is placed adjacent to an outermost face of a pressure-sensitive adhesive layer bearing two opposed faces, the innermost face of the pressure-sensitive adhesive layer is placed adjacent to a first face of a tearable-welding layer bearing two opposed faces;

wherein the cover comprises a welding layer with two opposed faces, the first face of which is placed adjacent to an innermost face of a support layer being two opposed faces;

wherein the second face of the tearable-welding layer and the second face of the welding layer are joined by welding along a seam in a welding region to form a welded seam; and wherein the packaging is opened by separating the cover and the container in the welding region.

2. The re-closable packaging according to claim 1, in which the complexable layer is joined to the bonding layer by extrusion-lamination.

3. The re-closable packaging according to claim 1, in which said container is a tub.

4. The re-closable packaging according to claim 1, in which said container is a flexible receptacle.

5. The re-closable packaging according to claim 1, in which said container is thermoformed.

6. The re-closable packaging according to claim 1, in which the packaging is opened by tearing and wherein the tearing takes place within the pressure-sensitive adhesive layer.

7. The re-closable packaging according to claim 1, in which the tearable-welding layer has a first melting point, the pressure-sensitive adhesive layer has a second melting point, and the first melting point is greater than the second melting point.

8. The re-closable packaging according to claim 1, in which said pressure-sensitive adhesive layer comprises a thermoplastic elastomer-based hot melt adhesive.

9. The re-closable packaging according to claim 1, in which said adhesive is formed of from 5 to 25% by weight of a master batch comprising a substance chosen from the group consisting of a filler, a processing agent, and mixtures thereof.

10. The re-closable packaging according to claim 1, in which said complexable layer and said tearable-welding layer each have the same composition.

11. The re-closable packaging according to claim 1, wherein the pressure-sensitive adhesive layer comprises two pressure-sensitive adhesive sub-layers.

12. The re-closable packaging according to claim 1, wherein the packaging is opened by separating the cover and the container in the welding region to form a first and a second pressure-sensitive adhesive sub-layer from the pressure-sensitive adhesive layer, the cover of the opened packaging comprising the first pressure-sensitive adhesive sub-layer and the container of the opened packaging comprising the second pressure-sensitive adhesive sub-layer.

13. The re-closable packaging according to claim 1, in which the tearable-welding layer and the welding layer each comprise a polyethylene.

14. The re-closable packaging according to claim 13, in which the polyethylene is a metallocene polyethylene.

15. The re-closable packaging according to claim 1, in which the complexable layer is joined to the bonding layer by lamination.

16. The re-closable packaging according to claim 15, in which the bonding layer is a polyurethane adhesive.

17. The re-closable packaging according to claim 15, in which the bonding layer is a coextrusion binder.

18. The re-closable packaging according to claim 1, in which the pressure-sensitive adhesive layer comprises two pressure-sensitive adhesive sub-layers, each sub-layer having the same composition.

19. The re-closable packaging according to claim 18, in which a structure comprising the complexable layer, the pressure-sensitive adhesive layer and the tearable-welding layer is obtained by collapsing a co-extrusion bubble.

20. The re-closable packaging according to claim 19, in which the co-extrusion bubble is collapsed in an oxidizing medium.

21. A re-closable packaging comprising a container and a cover;

wherein the container comprises a support layer bearing two opposed faces, the innermost face of which is joined to an outermost face of a bonding layer bearing two opposed faces by laminating;

the bonding layer is placed adjacent to a complexable layer bearing two opposed faces, the innermost face of the bonding layer being placed adjacent to the outermost face of the complexable layer, the innermost fare of the complexable layer is placed adjacent to an outermost face of a pressure-sensitive adhesive layer bearing two opposed faces, the innermost face of the pressure-sensitive adhesive layer is placed adjacent to a first face of a tearable-welding layer bearing two opposed faces;

wherein the cover comprises a welding layer with two opposed faces, the first face of which is placed adjacent to an innermost face of a support layer bearing two opposed faces;

wherein the second face of the tearable-welding layer and the second face of the welding layer are joined by welding along a seam in a welding region to form a welded seam; and wherein the packaging is opened by separating the cover and the container in the welding region.

22. The re-closable packaging according to claim 21, in which the bonding layer is a polyurethane adhesive.

23. The re-closable packaging according to claim 21, in which said container is thermoformed.

24. The re-closable packaging according to claim 21, in which the packaging is opened by tearing and wherein the tearing takes place within the pressure-sensitive adhesive layer.

25. The re-closable packaging according to claim 21, in which said pressure-sensitive adhesive layer comprises a thermoplastic elastomer-based hot melt adhesive.

26. The closable packaging according to claim 21, in which the tearable-welding layer and the welding layer each comprise a polyethylene.

27. The re-closable packaging according to claim 21, in which a structure comprising the complexable layer, the pressure-sensitive adhesive layer and the tearable-welding layer is obtained by collapsing a co-extrusion bubble.

28. The closable packaging according to claim 21, wherein the pressure-sensitive adhesive layer comprises two pressure-sensitive adhesive sub-layers.

29. The re-closable packaging according to claim 21, wherein the packaging is opened by separating the cover and the container in the welding region to form a first and a second pressure-sensitive adhesive sub-layer from the pressure-sensitive adhesive layer, the cover of the opened packaging comprising the first pressure-sensitive adhesive sub-layer and the container of the opened packaging comprising the second pressure-sensitive adhesive sub-layer.

30. A re-closable packaging comprising a container and a cover;

wherein the container comprises a support layer bearing two opposed faces, which is joined a complexable layer bearing two opposed faces, the innermost face of the support layer being placed adjacent to the outermost face of the complexable layer, the innermost face of the complexable layer is placed adjacent to an outermost face of a pressure-sensitive adhesive layer bearing two opposed faces, the innermost face of the pressure-sensitive adhesive layer is placed adjacent to a first face of a tearable-welding layer bearing two opposed faces;

wherein the cover comprises a welding layer with two opposed faces, the first face of which is placed adjacent to an innermost face of a support layer bearing two opposed faces;

wherein the second face of the tearable-welding layer and the second face of the welding layer are joined by welding along a seam in a welding region to form a welded seam; and wherein the packaging is opened by separating the cover and the container in the welding region.

31. The re-closable packaging according to claim 30, wherein the pressure-sensitive adhesive layer comprises two pressure-sensitive adhesive sub-layers.

32. The re-closable packaging according to claim 30, wherein the packaging is opened by separating the cover and the container in the welding region to form a first and a second pressure-sensitive adhesive sub-layer from the pressure-sensitive adhesive layer, the cover of the opened packaging comprising the first pressure-sensitive adhesive sub-layer and the container of the opened packaging comprising the second pressure-sensitive adhesive sub-layer.

33. The re-closable packaging according to claim 30, wherein the complexable layer is joined to the support layer by hot-calendering.

34. The re-closable packaging according to claim 30, wherein the complexable layer is joined to the support layer by extrusion-coating.

35. The re-closable packaging according to claim 30, wherein said container is thermoformed.

36. The re-closable packaging according to claim 30, wherein the packaging is opened by tearing and wherein the tearing takes place within the pressure-sensitive adhesive layer.

37. The re-closable packaging according to claim 30, wherein said pressure-sensitive adhesive layer comprises a thermoplastic elastomer-based hot melt adhesive.

38. The re-closable packaging according to claim 30, wherein the tearable-welding layer and the welding layer each comprise a polyethylene.

* * * * *